US006773240B2

(12) United States Patent
Dong

(10) Patent No.: US 6,773,240 B2
(45) Date of Patent: Aug. 10, 2004

(54) SINGLE PISTON DUAL CHAMBER FUEL PUMP

(75) Inventor: Mike Dong, Ann Arbor, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 22 days.

(21) Appl. No.: 10/157,693

(22) Filed: May 29, 2002

(65) Prior Publication Data

US 2003/0143091 A1 Jul. 31, 2003

Related U.S. Application Data

(60) Provisional application No. 60/352,434, filed on Jan. 28, 2002.

(51) Int. Cl.[7] ..... F04B 17/04; F04B 35/04

(52) U.S. Cl. ..... 417/418; 417/526; 417/545; 123/46 R

(58) Field of Search ..... 417/418, 416, 417/417, 419, 534, 535, 536, 537, 490, 494, 495, 545, 526, 393, 401, 403; 92/13.5, 84, 85 R; 123/506, 497, 46 R, 47 R

(56) References Cited

U.S. PATENT DOCUMENTS

| | | | | |
|---|---|---|---|---|
| 461,295 A | | 10/1891 | Van Depoele | |
| 2,472,647 A | * | 6/1949 | Covins | 74/49 |
| 2,515,110 A | | 7/1950 | Bornstein | 230/55 |
| 2,690,128 A | * | 9/1954 | Basilewsky | 103/53 |
| 2,701,331 A | * | 2/1955 | Holstl | 318/128 |
| 3,134,938 A | | 5/1964 | Morgan | 318/130 |
| 3,653,789 A | * | 4/1972 | Maroth | 417/534 |
| 3,884,125 A | | 5/1975 | Massie | 92/13.5 |
| 4,131,398 A | | 12/1978 | Rocchitelli | 417/418 |
| 4,400,144 A | * | 8/1983 | Drutchas et al. | 417/415 |
| 4,449,488 A | * | 5/1984 | Heaton | 123/46 R |
| 5,076,769 A | | 12/1991 | Shao | 417/534 |
| 5,221,196 A | | 6/1993 | Harbig et al. | 417/499 |
| 5,318,001 A | | 6/1994 | Djordjevic | 123/450 |
| 5,357,944 A | | 10/1994 | Rathmayr | 123/509 |

(List continued on next page.)

FOREIGN PATENT DOCUMENTS

| | | |
|---|---|---|
| DE | 3 134 972 | 3/1983 |
| EP | 0 515 816 B1 | 12/1995 |

(List continued on next page.)

OTHER PUBLICATIONS

English Abstract for German Publication No. DE 3134972.
Derwent English Abstract for EP 0 505 522 B1.
Derwent English Abstract for EP 0 515 816 B1.

(List continued on next page.)

*Primary Examiner*—Justine R. Yu
*Assistant Examiner*—Han L Liu
(74) *Attorney, Agent, or Firm*—Brinks Hofer Gilson & Lione

(57) ABSTRACT

A fuel pump for an automotive vehicle includes a housing having an opening extending therethrough, and a piston slidably supported within the opening. A pair of end caps are mounted to the housing, thereby encasing the piston within the opening. First and second pumping chambers are defined by the opening, first and second ends of the piston, and the end caps. Each of the first and second pumping chambers has an inlet adapted to allow fuel to flow into the pumping chambers and an outlet adapted to allow fuel to flow out of the pumping chambers. A drive device is adapted to move the piston back and forth within the opening, thereby alternately increasing and decreasing the volumes of the first and second pumping chambers.

20 Claims, 5 Drawing Sheets

U.S. PATENT DOCUMENTS

| | | | | | |
|---|---|---|---|---|---|
| 5,403,168 | A | * | 4/1995 | Evenson | 417/536 |
| 5,487,651 | A | | 1/1996 | Guentert et al. | 417/499 |
| 5,582,153 | A | | 12/1996 | Dutt et al. | 123/450 |
| 5,600,961 | A | * | 2/1997 | Whipple, III | 62/175 |
| 5,688,110 | A | | 11/1997 | Djordjevic | 417/254 |
| 5,727,388 | A | * | 3/1998 | Adamides | 60/417 |
| 5,769,056 | A | | 6/1998 | Geiger et al. | 123/502 |
| 5,887,571 | A | | 3/1999 | Yokota | 123/501 |
| 5,980,214 | A | | 11/1999 | Djordjevic | 417/205 |
| 6,086,348 | A | | 7/2000 | Nothdurft et al. | 418/260 |
| 6,135,090 | A | * | 10/2000 | Kawachi et al. | 123/446 |
| 6,135,735 | A | | 10/2000 | Siegel | 417/568 |
| 6,146,115 | A | | 11/2000 | Alaze | 417/549 |
| 6,152,708 | A | | 11/2000 | Ruessler et al. | 417/490 |
| 6,171,083 | B1 | * | 1/2001 | Schuller | 417/549 |
| 6,186,118 | B1 | * | 2/2001 | Spakowski | 123/452 |
| 6,186,746 | B1 | | 2/2001 | Bodzak et al. | 417/199.2 |
| 6,234,774 | B1 | * | 5/2001 | Siviero | 417/534 |

FOREIGN PATENT DOCUMENTS

| | | |
|---|---|---|
| EP | 0 800 620 B1 | 7/1996 |
| EP | 0 505 522 B1 | 12/1996 |
| EP | 0 610 641 B1 | 11/1997 |
| EP | 0 846 224 B1 | 12/2000 |
| GB | 1078844 | 8/1967 |
| JP | 10-89084 | 4/1998 |
| JP | 11-343944 | 6/1998 |
| JP | 2000-240531 | 11/1999 |
| WO | WO 96/18027 | 6/1996 |
| WO | WO 97/49916 | 12/1997 |
| WO | WO 01/07778 A1 | 2/2001 |

OTHER PUBLICATIONS

Derwent English Abstract for EP 0 610 641 B1.
Derwent English Abstract for EP 0 800 620 B1.
Derwent English Abstract for EP 0 846 224 B1.
Derwent English Abstract for Japanese 10–89084.
Derwent English Abstract for Japanese 2000–240531.
Derwent English Abstract for Japanese 11–343944.
Derwent English Abstract for PCT WO/96/18027.
Derwent English Abstract for PCT WO 97/49916.
Derwent English Abstract for PCT WO/01/07778 A1.

* cited by examiner

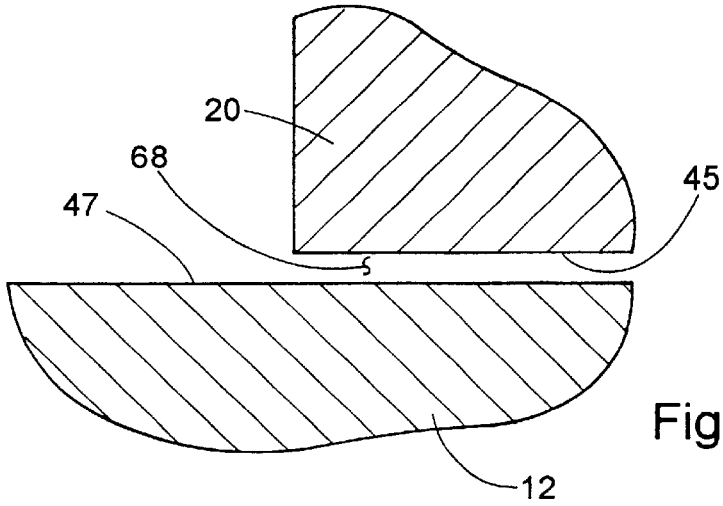
Fig. 3
Fig. 4
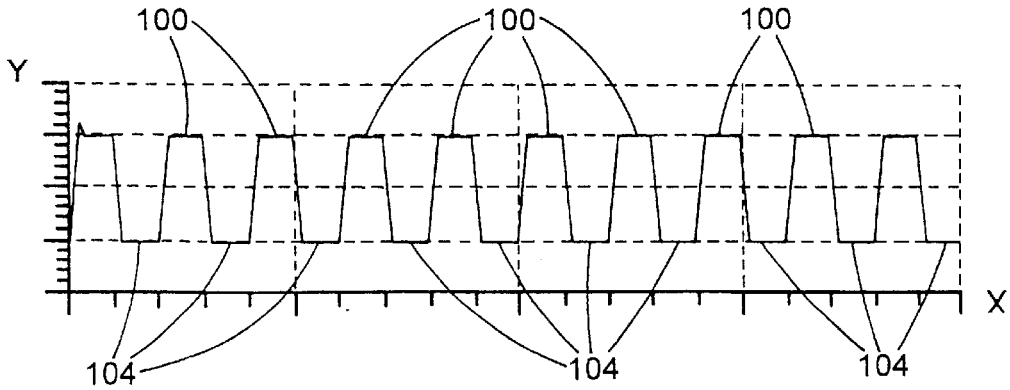
Fig. 5
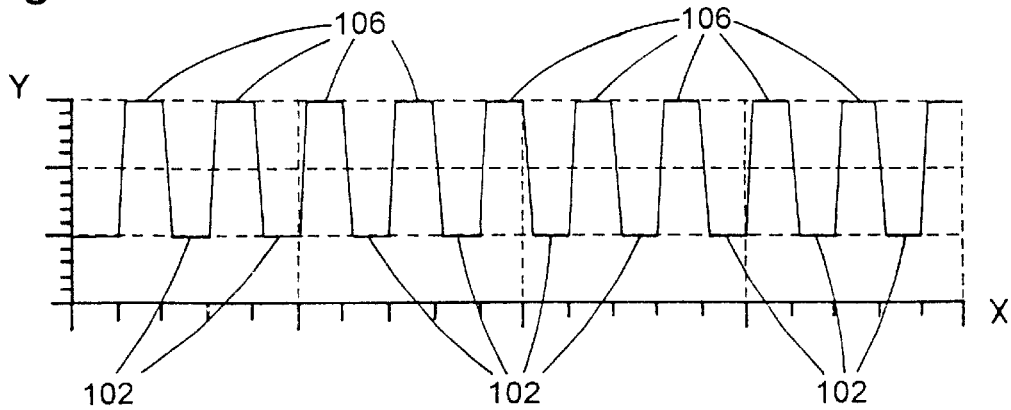

SINGLE PISTON DUAL CHAMBER FUEL PUMP

CROSS REFERENCE TO RELATED APPLICATIONS

This application claims the priority date of related provisional application Serial No. 60/352,434 filed Jan. 28, 2002.

TECHNICAL FIELD

The present invention generally relates to a fuel pump for an internal combustion engine. More specifically, the present invention relates to a fuel pump that provides dual chamber pumping action with a single reciprocating plunger.

BACKGROUND

In low pressure applications, on the order of 40–60 psi, turbine impeller fuel pumps can be used to deliver fuel from the fuel tank in an automobile to the fuel rail and cylinders of the engine. However, conventional turbine impeller fuel pumps cannot deliver fuel at the pressures required in high pressure fuel systems, which are on the order of 300 psi. Piston type fuel pumps are more capable of delivering the fuel at these higher fuel pressures, however, the piston pumps have some significant drawbacks. A single piston pump delivers fuel at fluctuating pressures due to the pressure drops during the intake stroke of the piston. To alleviate the pressure fluctuations, multiple piston pumps have been developed, wherein the timing of the strokes of the pistons is staggered to reduce the pressure fluctuations in the fuel flow. However, conventional multiple piston pumps are large, and have many parts, thereby making them heavy and expensive. Therefore, there is a need for a piston fuel pump that provides a relatively stable fuel pressure with a single piston.

BRIEF DESCRIPTION OF THE DRAWINGS

FIG. 3 is an enlarged view of a portion of FIG. 2 as indicated by circle 3;

FIGS. 4 and 5 are fuel pressure profiles for first and second pumping chambers;

DETAILED DESCRIPTION OF THE PREFERRED EMBODIMENTS

The following description of the preferred embodiment of the invention is not intended to limit the scope of the invention to this preferred embodiment, but rather to enable any person skilled in the art to make and use the invention.

Figure 1:
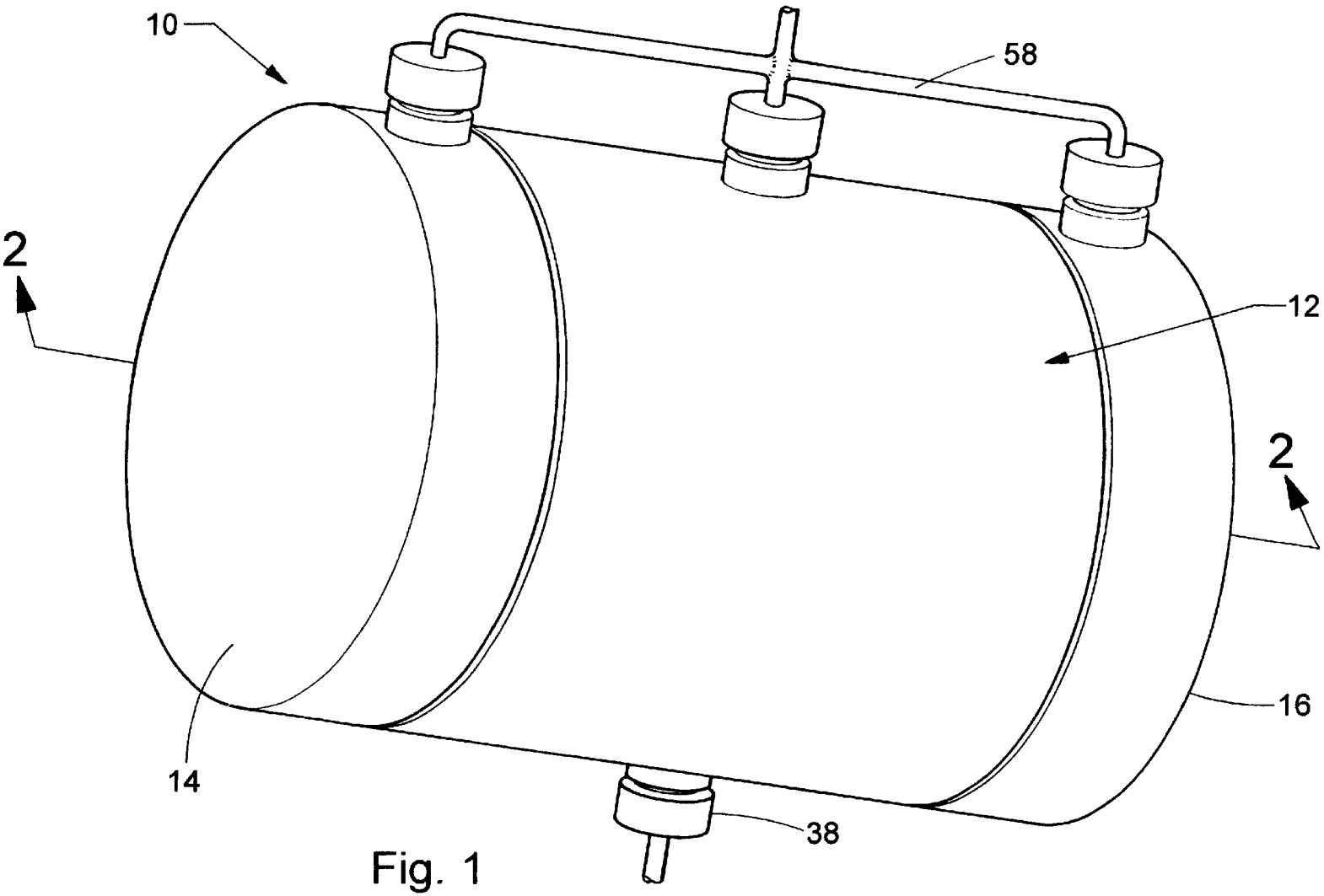
FIG. 1 is a perspective view of a first preferred embodiment.
Figure 2:
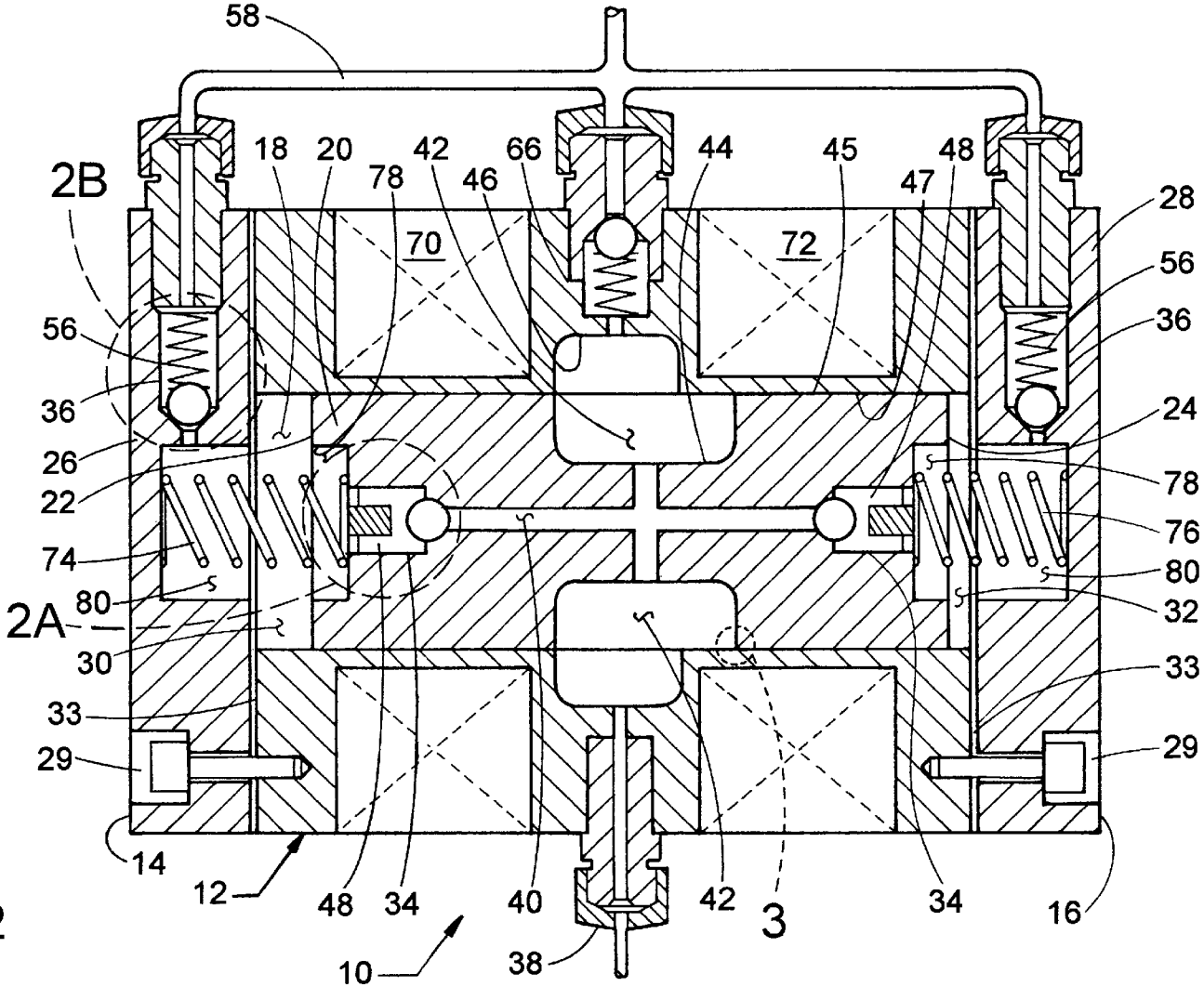
FIG. 2 is a side sectional view taken along line 2—2 of FIG. 1.

Referring to FIGS. 1 and 2, first preferred embodiment of a fuel pump for an automotive vehicle is shown generally at 10. The fuel pump 10 includes a housing 12 having a first end 14 and a second end 16. An opening 18 extends through the housing 12 between the first and second ends 14, 16, and a piston 20 having a first end 22 and a second end 24 is slidably supported within the opening 18. A first end cap 26 is mounted to the first end 14 of the housing 12 and a second end cap 28 is mounted to the second end 16 of the housing 12, thereby encasing the piston 20 within the opening 18 and defining a pair of pumping chambers 30, 32. The end caps 26, 28 are secured to the housing 12 by fasteners 29.

The first pumping chamber 30 is defined by the opening 18 within the housing 12, the first end 22 of the piston 20, and the first end cap 26, and the second pumping chamber 32 is defined by the opening 18 within the housing 12, the second end 24 of the piston 20, and the second end cap 28. Preferably, the fuel pump 10 is to be mounted within the fuel tank of the vehicle. In this instance, minor leakage of fuel from the pump 10 is not a concern. However, alternatively, the fuel pump 10 could be mounted outside the fuel tank of the vehicle whereby it is important that fuel does not leak from the fuel pump. If the fuel pump 10 is to be mounted outside of a fuel tank, then a pair of seals 33 are placed between the end caps 26, 28 and the ends 14, 16 of the housing to keep fuel from leaking from the pump 10. The seals can be formed from an epoxy gel or any other conventional seal that is placed between the end caps 26, 28 and the first and second ends 14, 16 of the housing 12.

Each of the first and second pumping chambers 30, 32 includes an inlet 34 and an outlet 36. The inlets 34 are adapted to allow fuel to flow into the pumping chambers 30, 32, and the outlets 36 are adapted to allow fuel to flow out of the pumping chambers 30, 32. The housing 12 includes a supply port 38 which is adapted to connect to a supply of fuel. A low pressure passage 40 interconnects the supply port 38 to the inlets 34 of the first and second pumping chambers 30, 32.

Preferably, the low pressure passage 40 includes a reservoir 42 positioned between the supply port 38 and the inlets 34. The reservoir maintains a volume of fuel ahead of the inlets 34 to prevent cavitation and to stabilize the flow within the low pressure passage 40. As shown in FIG. 2, the reservoir 42 is defined by an outwardly facing annular groove 44 formed within and extending around an outer surface 45 of the piston 20 and an inwardly facing annular groove 46 formed within and extending around an inner surface 47 of the opening 18.

The outwardly facing annular groove 44 of the piston 20 is larger than the inwardly facing annular groove 46 such that the grooves 44, 46 are always in fluid communication with one another as the piston 20 slides back and forth within the opening 18. This is important because preferably the volume of the reservoir 42 remains substantially constant in order to provide a steady fuel flow. If the volume of the reservoir 42 changed significantly, then the reservoir 42 would not effectively prevent cavitation and stabilize the fuel flow through the low pressure passage 40.

Each of the inlets 34 includes an inlet valve 48 which is adapted to allow fuel to flow into the pumping chambers 30, 32 and to prevent fuel from flowing out of the pumping chambers 30, 32 and back into the low pressure passage 40. Preferably, the inlet valves 48 are free-flow one-way valves, whereby whenever the pressure within the low pressure passage 40 is higher than the pressure inside the pumping chambers 30, 32, fuel will flow into the pumping chambers 30, 32 through the inlet valves 48.

Figure 2A:
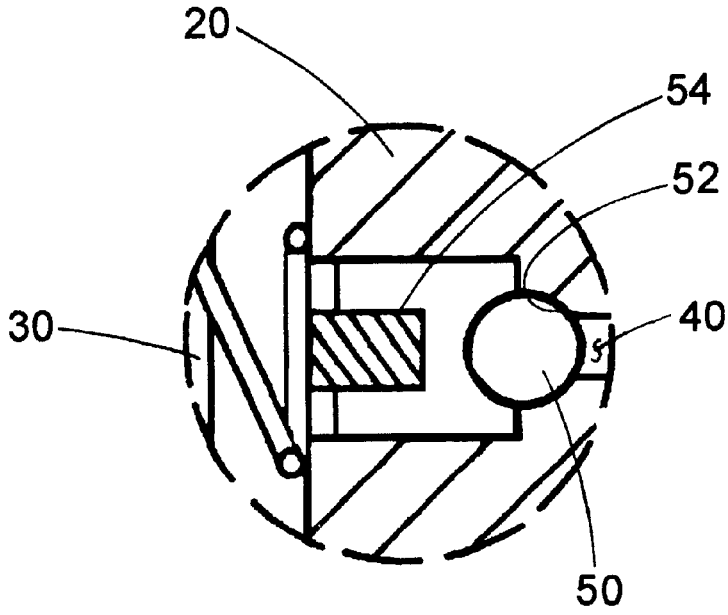
FIG. 2A is an enlarged view of a portion of FIG. 2 as indicated by circle 2A.

As shown in FIG. 2A, the inlet valves 48 are ball type valves including a ball 50, a ball seat 52, and a stop 54. The ball seat 52 faces toward the pumping chamber 30, 32 and the ball 50 is adapted to fit within the ball seat 52 such that when the pressure within the pumping chambers 30, 32 is higher than the pressure within the low pressure passage 40, the ball 50 will be pushed against the ball seat 52 to substantially seal the inlet valve 48 to prevent fuel from flowing out of the pumping chambers 30, 32. When the pressure within the pumping chambers 30, 32 is lower than the pressure within the low pressure passage 40, the ball 50 will be pushed away from the ball seat 52, thereby allowing fuel to flow through the inlet valves 48 and into the pumping chambers 30, 32. The stop 54 is positioned at a controlled distance from the ball seat 52 such that the ball 50 is allowed to fall away from the ball seat 52 sufficiently to allow fuel to flow therethrough, and to keep the ball 50 in close enough proximity to the ball seat 52 such that if the fuel flow is reversed, the ball 50 will be rapidly pushed back against the ball seat 52.

Each of the outlets 36 includes an outlet valve 56 which is adapted to allow fuel to flow out of the pumping chambers 30, 32 and to prevent fuel from flowing into the pumping chambers 30, 32. Preferably, the outlet valves 56 are regulated one-way valves, whereby fuel will only flow through the outlet valves 56 and out of the pumping chambers 30, 32 when the pressure within the pumping chambers 30, 32 exceeds a pre-determined value. A high pressure passage 58 is adapted to interconnect the outlets 36 of the pumping chambers 30, 32 to the fuel delivery system of the vehicle.

Figure 2B:
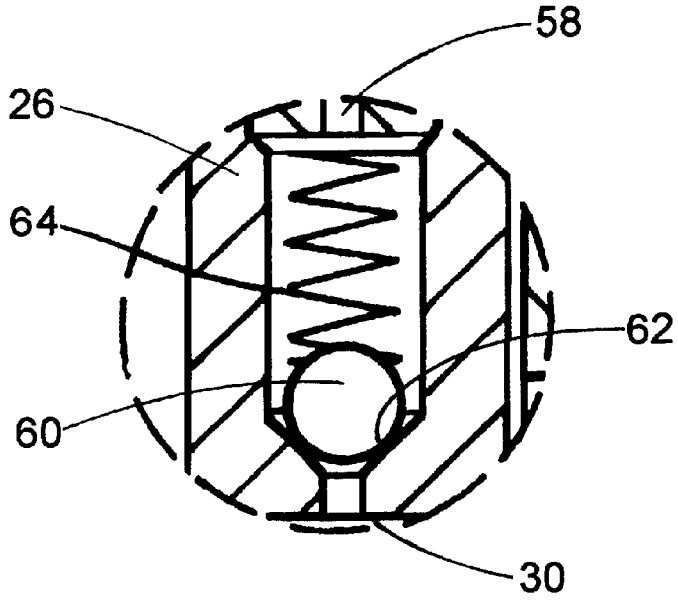
FIG. 2B is an enlarged view of a portion of FIG. 2 as indicated by circle 2B.

As shown in FIG. 2B, the outlet valves 56 are biased ball type valves including a ball 60, a ball seat 62, and a biasing spring 64. The ball seat 62 faces away from the pumping chamber 30, 32 and the ball 60 is adapted to fit within the ball seat 62 such that when the pressure within the pumping chambers 30, 32 is lower than the pressure within the high pressure passage 58, the ball 60 will be pushed against the balls seat 62 to substantially seal the outlet valves 56 to prevent fuel from flowing into the pumping chambers 30, 32 from the high pressure passage 58.

The biasing spring 64 provides additional force to maintain the ball 60 into the ball seat 62 when the pressure within the pumping chambers 30, 32 exceeds the pressure within the high pressure passage 58. In order for the outlet valves 56 to open, the pressure within the pumping chambers 30, 32 must not only exceed the pressure in the high pressure passage 58, but also the force of the biasing spring 64. In this way, the biasing spring 64 can be selected such that the outlet valves 56 will not open until the pressure within the pumping chambers 30, 32 exceeds a pre-determined amount.

In the preferred embodiment, the high pressure passage 58 includes a pressure relief valve 66. Preferably, the pressure relief valve 66 is a regulated one-way valve similar to the outlet valves 56. The pressure relief valve is adapted to allow fuel to flow from the high pressure passage 58 back into the reservoir 42 when the pressure within the high pressure passage 58 exceeds a pre-determined amount. This is preferable to allow the pressure within the high pressure passage 58 to bleed off. As the engine of the vehicle is running, fuel is being pumped into the high pressure passage 58 and to the engine. When the engine is suddenly shut down, the demand for fuel ceases, and the pump 10 shuts off, thereby stopping the delivery of more fuel to the high pressure system 58. However, heat from the engine and the fuel delivery system causes the fuel within the high pressure passage 58 to expand. To alleviate the pressure caused by this expansion, the pressure relief valve 66 allows fuel to bleed back into the reservoir 42 and the low pressure passage 40, where the fuel is free to flow back into the fuel tank of the vehicle.

In the preferred embodiment, the inner surface 47 of the opening 18 and the outer surface 45 of the piston 20 are sized such that there is a clearance fit, or gap 68 between the inner surface 47 and the outer surface 45, as shown in FIG. 3. The gap 68 is in fluid communication with the reservoir 42 such that fuel will leak into the gap 68, thereby providing a liquid lubricant layer between the inner surface 47 of the opening 18 and the outer surface 45 of the piston 20 when the piston slides back and forth within the opening 18. Preferably, the inner surface 47 of the opening 18 and the outer surface 45 of the piston 20 are polished to a very fine surface finish to further reduce friction therebetween.

The pump 10 includes a drive device which is adapted to move the piston 20 back and forth within the opening 18. As the piston 20 moves toward the first end 14 of the housing, the volume of the first pumping chamber 30 is reduced and the volume of the second pumping chamber 32 is increased. As the volume of the first pumping chamber 30 is reduced, the pressure within the first pumping chamber 30 will increase until the pressure is high enough to overcome the biasing force of the biasing spring 64 within the outlet valve 56, thereby causing the outlet valve 56 to open and releasing high pressure fuel into the high pressure passage 58 for delivery to the engine of the vehicle.

Simultaneously, as the volume of the second pumping chamber 32 is increased, a vacuum is formed therein causing the pressure within the second pumping chamber 32 to drop below the pressure within the low pressure passage, thereby allowing the inlet valve 48 to open such that fuel flows into the second pumping chamber 32. When the piston 20 moves toward the first end 14 of the housing 12, the first pumping chamber 30 experiences a pumping action as fuel is pumped from the first pumping chamber through the outlet 36 and the second pumping chamber 32 experiences a sucking action as fuel is drawn into the second pumping chamber 32 through the inlet 34.

Further, when the piston 20 moves toward the second end 16 of the housing 12, the second pumping chamber 32 experiences a pumping action as fuel is pumped from the second pumping chamber 32 through the outlet 36 and the first pumping chamber 30 experiences a drawing action as fuel is drawn into the first pumping chamber 30 through the inlet 34. As the drive device moves the piston 20 back and forth within the opening 18, the first and second pumping chambers 30, 32 alternate between pumping and drawing actions such that one of the two pumping chambers 30, 32 is always performing a pumping action to provide constant delivery of fuel to the high pressure passage 58.

Figure 6:
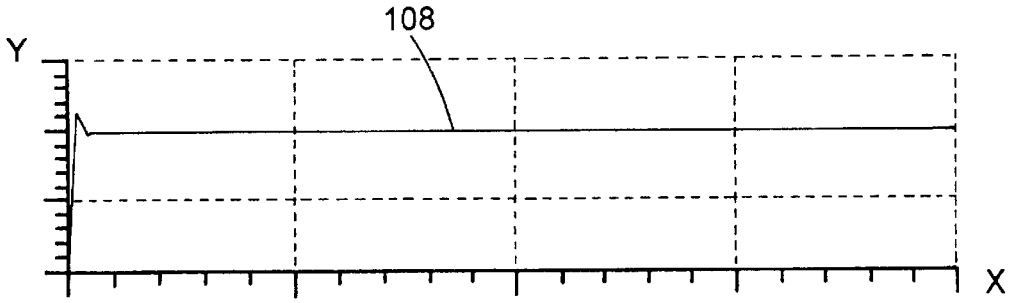
FIG. 6 is the resultant fuel pressure profile within the fuel rail of a vehicle incorporation the fuel pump.

Referring to FIGS. 4 and 5, the pressure profiles of the first and second pumping chambers 30, 32 are shown wherein the x axis tracks time, and the y axis measures the pressure output from the pumping chambers 30, 32. The pressure profile of the first pumping chamber 30 is shown in FIG. 4, and the pressure profile of the second pumping chamber 32 is shown in FIG. 5. The pumping action of the first pumping chamber 30 when the piston 20 is moved toward the first end 14 of the housing 12 results in high pressure output zones 100. The corresponding drawing action of the second pumping chamber 32 results in zero pressure output dead zones 102. However, when the piston 20 moves toward the second end 16 of the housing 12, the first pumping chamber 30 experiences zero pressure output dead zones 104 and the second pumping chamber 32 experiences high pressure output zones 106. Since the output of both the first and second pumping chambers 30, 32 goes to the high pressure passage 58, the resulting pump output 108 is relatively stable as shown in FIG. 6.

In the first preferred embodiment shown in FIG. 2, the drive device comprises a pair of electromagnetic coils 70, 72. A first coil 70 extends about the housing 12 adjacent the first end 14 and a second coil 72 extends about the housing 12 adjacent the second end 16. When the coil adjacent the first end 14 of the housing 12 is energized, a magnetic flux passes across the first pumping chamber 30 from the first end cap 26 to the first end 22 of the piston 20. The magnetic flux causes a magnetic attraction between the first end 22 of the piston 20 and the first end cap 26, thereby moving the piston 20 toward the first end 14 of the housing 12.

Likewise, when the coil adjacent the second end 16 of the housing 12 is energized, a magnetic flux passes across the second pumping chamber 32 from the second end cap 28 to the second end 24 of the piston 20. The magnetic flux causes a magnetic attraction between the second end 24 of the piston 20 and the second end cap 28, thereby moving the piston 20 toward the second end 16 of the housing 12. By alternatively energizing the first and second coils 70, 72, the piston 20 is moved back and forth within the opening 18. In the first preferred embodiment, it is required that the housing 12, the piston 20 and the end caps 26, 28 are made from a magnetically conductive material to allow the magnetic flux to pass therethrough. The alternating frequency of the electromagnetic fields controls the piston motion frequency, and therefore, the pump output flow.

When neither the first or second coil 70, 72 is energized and the pump 10 is not running, the piston 20 is biased to a position centered within the opening 18 by a biasing element. In the first preferred embodiment, the biasing element comprises a pair of springs 74, 76. A first spring 74 is positioned between the first end 22 of the piston 20 and the first end cap 26 within the first pumping chamber 30 and a second spring 76 is positioned between the second end 24 of the piston 20 and the second end cap 28 within the second pumping chamber 32. The springs 74, 76 have substantially the same stiffness such that when no other external forces are placed upon the piston 20, the springs 74, 76 will bias the piston 20 centrally within the opening 18. Additionally, the stiffness of the springs 74, 76 should be relatively low such that the springs 74, 76 do not provide significant resistance to the movement of the piston 20 by the electromagnetic coils 70, 72.

Preferably, the first and second pumping chambers 30, 32 each include a pair of opposing spring pockets 78, 80. A first spring pocket 78 is formed within each of the first and second ends 22, 24 of the piston 20, and a second spring pocket 80 is formed within each of the first and second end caps 26, 28. Distal ends of said springs 74, 76 are supported within the spring pockets 78, 80 to keep the springs 74, 76 positioned and oriented correctly within the first and second pumping chambers 30, 32.

Figure 7:
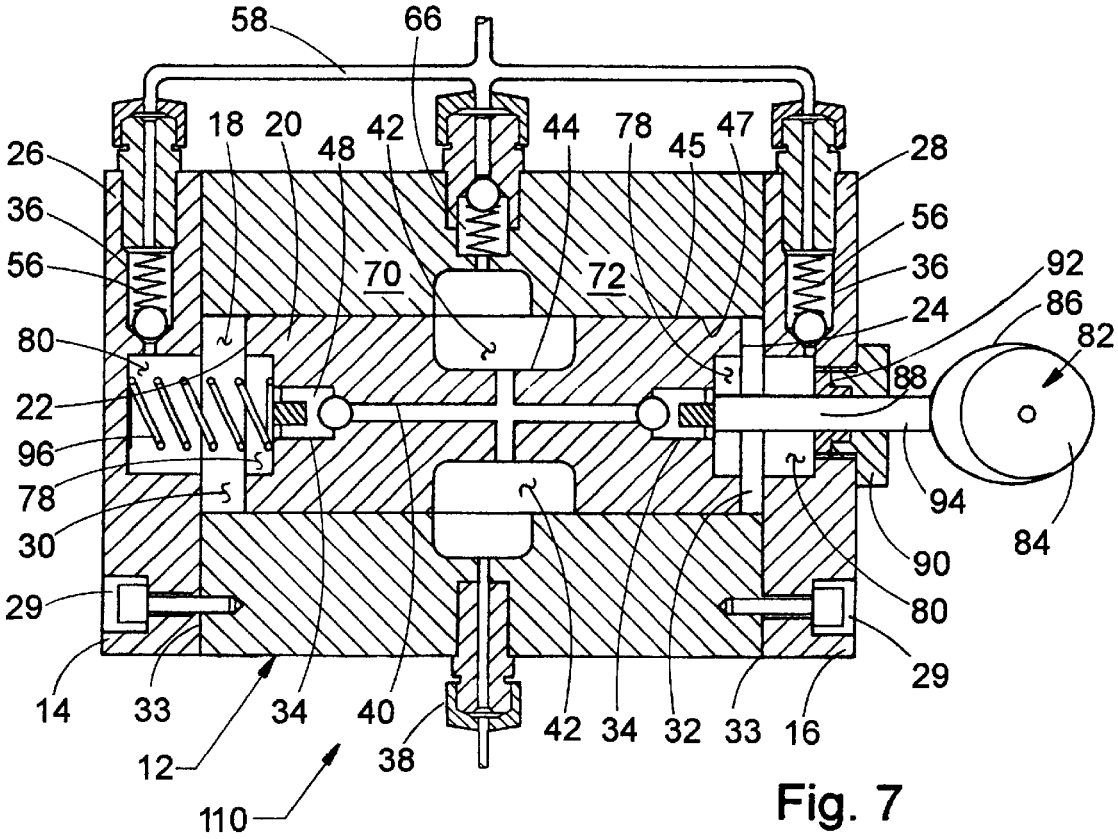
FIG. 7 is a side sectional view similar to FIG. 2 of a second preferred embodiment.

A second preferred embodiment 110 is shown in FIG. 7, wherein like components are numbered the same as in the first preferred embodiment of FIG. 2. In the second preferred embodiment, the drive device comprises a two-way cam 82 driven by a mechanical shaft from engine or an electric motor (not shown). The two-way cam includes a rotating lobe 84 which presents a cam surface 86. The second end 24 of the piston 20 includes a rod 88 extending therefrom. The rod 88 extends from the second end 24 of the piston 20, across the second pumping chamber 32, and through an opening 90 on the second end cap 28. Preferably, a seal 92 is positioned within the opening 90 which is adapted to allow sliding movement of the rod 88 therein while preventing fuel from leaking out through the opening 90 from the second pumping chamber 32.

The rod 88 includes a distal end 94, opposite the piston 20, which is adapted for sliding engagement with the cam surface 86, such that as the lobe 84 rotates, the distal end 94 of the rod 88 follows the cam surface 86 thereby moving the rod 88, and in turn the piston 20, back and forth. The two-way cam 82 should have a high order cam profile and be designed specifically to eliminate system dynamic vibrations.

Preferably, the second preferred embodiment includes a biasing element to keep the distal end 94 of the rod 88 in sliding engagement with the cam surface 86 of the lobe 84. As shown in FIG. 7, the biasing element is a biasing spring 96 that is positioned between the first end 22 of the piston 20 and the first end cap 26 within the first pumping chamber 30. Preferably, the first pumping chamber 30 includes a pair of opposing spring pockets 78, 80 similar to the spring pockets 78, 80 of the first preferred embodiment to maintain the position and orientation of the spring 96.

The stiffness of the biasing springs 74, 76 of the first preferred embodiment is not critical, so long as they are substantially equal. However, the stiffness of the biasing spring 96 of the second preferred embodiment must be high enough to provide sufficient force to push the piston 20 back toward the second end 16 of the housing 12 and to keep the distal end 94 of the rod 88 in sliding engagement with the cam surface 86.

The foregoing discussion discloses and describes two preferred embodiments. One skilled in the art will readily recognize from such discussion, and from the accompanying drawings and claims, that changes and modifications can be made to the preferred embodiments without departing from the true spirit and fair scope of the inventive concepts as defined in the following claims. The preferred embodiments have been described in an illustrative manner, and it is to be understood that the terminology which has been used is intended to be in the nature of words of description rather than of limitation.

What is claimed is:

1. A fuel pump for an automotive vehicle comprising:

a housing having a first end, a second end, and an opening extending through said housing between said first and second ends;

a piston having a first end and a second end slidably supported within said opening;

a first end cap mounted to said first end of said housing and a second end cap mounted to said second end of said housing, thereby encasing said piston within said opening;

a first pumping chamber defined by said opening, said first end of said piston, and said first end cap, and a second pumping chamber defined by said opening, said second end of said piston, and said second end cap, each of said first and second pumping chambers having an inlet adapted to allow fuel to flow into said pumping chambers from a low pressure passage, and an outlet adapted to allow fuel to flow out of said pumping chambers into a high pressure passage;

a drive device adapted to move said piston back and forth within said opening wherein as said piston moves toward said first end, the volume of said first pumping chamber is reduced and the volume of said second pumping chamber is increased, thereby forcing fuel from said first pumping chamber through said outlet of said first pumping chamber and into said high pressure passage and drawing fuel from said low pressure passage into said second pumping chamber, and as said piston moves toward said second end, the volume of said first pumping chamber is increased and the volume of said second pumping chamber is reduced, thereby forcing fuel from said second pumping chamber through said outlet of said second pumping chamber and into said high pressure passage and drawing fuel from said low pressure passage into said first pumping chamber;

said low pressure passage including a reservoir positioned between a supply port and said inlets, said reservoir adapted to maintain a volume of fuel ahead of said inlets to prevent cavitation within said low pressure passage and to stabilize the flow within said low pressure passage;

said reservoir including an outwardly facing annular groove formed within and extending around said piston and an inwardly facing annular groove formed within and extending around said opening.

2. The fuel pump of claim 1 wherein each of said inlets includes an inlet valve adapted to allow fuel to flow into said pumping chambers from said low pressure passage and to prevent fuel from flowing out of said pumping chambers into said low pressure passage and each of said outlets includes an outlet valve adapted to allow fuel to flow out of said pumping chambers into said high pressure passage and to prevent fuel from flowing into said pumping chambers from said high pressure passage.

3. The fuel pump of claim 2 wherein said inlet valves are free-flow one-way valves, whereby whenever the pressure within said low pressure passage is higher than the pressure inside the pumping chambers, fuel will flow into said pumping chambers, from said low pressure passage, through said inlet valves.

4. The fuel pump of claim 2 wherein said outlet valves are regulated one-way valves, whereby fuel will only flow through said outlet valves and out of said pumping chambers and into said high pressure passage when the pressure within said pumping chambers exceeds a pre-determined value.

5. The fuel pump of claim 1 further comprising a biasing element that positions said piston centrally within said opening when said fuel pump is at rest.

6. The fuel pump of claim 5 wherein said biasing element includes a pair of springs, one of said springs being positioned between said first end of said piston and said first end cap within said first pumping chamber and the other of said springs being positioned between said second end of said piston and said second end cap within said second pumping chamber.

7. The fuel pump of claim 6 wherein said first and second pumping chambers each include a pair of opposing spring pockets, one of said pair of spring pockets being formed within said piston and the other of said pair of spring pockets being formed within said end cap, whereby distal ends of said springs within said pumping chambers are supported within said opposing spring pockets.

8. The fuel pump of claim 1 wherein said support port is adapted to connect a supply of fuel to said low pressure passage.

9. The fuel pump of claim 1 wherein said high pressure passage is adapted to connect to the fuel delivery system of the vehicle and includes a pressure relief valve adapted to allow fuel to flow from said high pressure passage into said reservoir.

10. The fuel pump of claim 9 wherein said pressure relief valve is a regulated one-way valve, whereby fuel will only flow through said pressure relief valve when the pressure within said high pressure passage exceeds a pre-determined value.

11. A The fuel pump of claim 1 further including a pair of seals, one of said seals being positioned between said first end of said housing and said first end cap and the other of said seals being positioned between said second end of said housing and said second end cap.

12. The fuel pump of claim 1 wherein said opening includes an inner surface and said piston includes an outer surface, said inner surface and said outer surface being sized such that there is a clearance fit between said opening and said piston whereby when said piston slides back and forth within said opening, fuel from said low pressure passage leaks between said outer surface of said piston and said inner surface of said opening to provide lubrication between said outer surface of said piston and said inner surface of said opening.

13. The fuel pump of claim 12 wherein said inner surface of said opening and said outer surface of said piston are polished surfaces.

14. A The fuel pump of claim 1 wherein said drive device includes a pair of electro-magnetic coils, one of said coils extending about said housing adjacent each of said first and second ends, whereby when the coil adjacent said first end of said housing is energized, a magnetic flux passing from said first end cap to said first end of said piston magnetically attracts said piston toward said first end cap and when the coil adjacent the second end of said housing is energized, a magnetic flux passing from said second end cap to said second end of said piston magnetically attracts said piston toward said second end cap.

15. The fuel pump of claim 1 wherein said drive device includes a driven two-way cam.

16. The fuel pump of claim 15 including a rod extending from said second end of said piston and outward through an opening on said second end cap, said rod having a distal end opposite said piston that engages said two-way cam.

17. The fuel pump of claim 16 further including a seal positioned within said opening formed within said second end cap which substantially prevents fuel from leaking out of said second pumping chamber through said opening within said second end cap while allowing sliding movement of said rod therein.

18. The fuel pump of claim 16 further including a biasing element that maintains said distal end of said rod in engagement with said two-way cam.

19. The fuel pump of claim 18 wherein said biasing element comprises a spring positioned between said first end of said piston and said first end cap within said first pumping chamber.

20. The fuel pump of claim 19 wherein said first pumping chamber includes a pair of opposing spring pockets, one of said pair of spring pockets being formed within said first end of said piston and the other of said pair of spring pockets being formed within said first end cap, whereby distal ends of said spring are supported within said opposing spring pockets.

* * * * *

UNITED STATES PATENT AND TRADEMARK OFFICE

CERTIFICATE OF CORRECTION

PATENT NO. : 6,773,240 B2
APPLICATION NO. : 10/157693
DATED : August 10, 2004
INVENTOR(S) : Mike Dong It is certified that error appears in the above-identified patent and that said Letters Patent is hereby corrected as shown below:

On the Title Page

In column 1, line 5, under "U.S. PATENT DOCUMENTS", delete "Holstl" and substitute --Holst-- in its place.

In the Claims

In claim 11, line 6, before "The fuel pump" delete "A".

Signed and Sealed this

Fourteenth Day of August, 2007

JON W. DUDAS
*Director of the United States Patent and Trademark Office*